US011746611B2

(12) United States Patent
Pye

(10) Patent No.: US 11,746,611 B2
(45) Date of Patent: Sep. 5, 2023

(54) WHIPSTOCK RETRIEVING BIT

(71) Applicant: SAUDI ARABIAN OIL COMPANY, Dhahran (SA)

(72) Inventor: Richard Mark Pye, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 1 day.

(21) Appl. No.: 17/386,751

(22) Filed: Jul. 28, 2021

(65) Prior Publication Data

US 2023/0036409 A1 Feb. 2, 2023

(51) Int. Cl.

| | |
|---|---|
| ***E21B 23/04*** | (2006.01) |
| ***E21B 7/06*** | (2006.01) |
| ***E21B 29/06*** | (2006.01) |
| ***E21B 34/06*** | (2006.01) |
| ***E21B 34/16*** | (2006.01) |
| ***E21B 47/013*** | (2012.01) |

(52) U.S. Cl.

CPC ..... *E21B 23/0413* (2020.05); *E21B 7/061* (2013.01); *E21B 23/0419* (2020.05); *E21B 29/06* (2013.01); *E21B 34/16* (2013.01); *E21B 34/066* (2013.01); *E21B 47/013* (2020.05)

(58) Field of Classification Search

CPC ... E21B 23/0413; E21B 7/061; E21B 23/0419; E21B 29/06; E21B 34/066; E21B 34/16; E21B 47/013

See application file for complete search history.

(56) References Cited

U.S. PATENT DOCUMENTS

| | | | | |
|---|---|---|---|---|
| 2,107,420 | A * | 2/1938 | Kothny | E21B 31/12 175/82 |
| 2,298,706 | A * | 10/1942 | Kothny | E21B 47/024 166/255.3 |
| 5,549,163 | A | 8/1996 | Sieber | |
| 5,678,634 | A | 10/1997 | Rehbock et al. | |
| 6,843,314 | B2 | 1/2005 | Toulouse et al. | |
| 7,997,336 | B2 | 8/2011 | Sokol et al. | |
| 8,540,035 | B2* | 9/2013 | Xu et al. | E21B 23/04 175/269 |

(Continued)

FOREIGN PATENT DOCUMENTS

| | | | |
|---|---|---|---|
| CN | 2668821 | Y | 1/2005 |
| CN | 107100574 | A | 8/2017 |

OTHER PUBLICATIONS

International Search Report and Written Opinion issued in corresponding International Patent Application No. PCT/US2022/038683, mailed on Sep. 23, 2022 (11 pages).

(Continued)

*Primary Examiner* — Nicole Coy

(74) *Attorney, Agent, or Firm* — Osha Bergman Watanabe & Burton LLP

(57) ABSTRACT

A retrievable whipstock assembly for a wellbore includes a whipstock including a longitudinal body and an anchor connection, a deflection surface provided on the longitudinal body with a first engagement element, and a drilling assembly including a drill housing and a second engagement element. The second engagement element is selectively extendible between a recessed position and an extended position. In the extended position the second engagement element is engageable with the first engagement element.

18 Claims, 18 Drawing Sheets

(56) References Cited

U.S. PATENT DOCUMENTS

| | | | | |
|---|---|---|---|---|
| 9,004,091 | B2* | 4/2015 | Joseph et al. | F16K 27/0209 137/533.15 |
| 9,556,696 | B2* | 1/2017 | Donovan et al. | E21B 29/005 |
| 10,597,978 | B2 | 3/2020 | Jelly et al. | |
| 10,934,810 | B2* | 3/2021 | Dancer | E21B 41/0035 |
| 2004/0108739 | A1 | 6/2004 | Beeman et al. | |
| 2008/0029276 | A1 | 2/2008 | Templeton et al. | |
| 2015/0136398 | A1 | 5/2015 | Armstrong et al. | |

OTHER PUBLICATIONS

Techmaster Oil Tools Inc., "Whipstock"; Masterwhipstock: A Techmaster Product; 2019; <https://irp-cdn.multiscreensite.com/81b5819e/files/uploaded/Final%20WS%202019.pdf>; Accessed Jan. 18, 2021 (21 pages).

* cited by examiner

WHIPSTOCK RETRIEVING BIT

BACKGROUND

Hydrocarbon resources are typically located below the earth's surface in subterranean porous rock formations, often called reservoirs. These hydrocarbon-bearing reservoirs can be found in depths of tens of thousands of feet below the surface. In order to extract the hydrocarbon fluids, also referred to as oil and/or gas, wells may be drilled to gain access to the reservoirs. Wells may be drilled vertically from the surface, deviated from vertical, or vertical to horizontal in order to most effectively and efficiently access the subsurface hydrocarbon reservoirs.

A step in the drilling operations, or well construction, involves casing the wellbore with tubulars and cementing the tubulars in place. This isolates the internal conduit or well from the surrounding formations that may be prone to collapse or have undesirable hazards present such as shallow gas. Each section of the well is typically drilled with a drill bit that is attached to a length of drill string that extends from the bottom of the wellbore to a drilling rig at surface. Upon completion of drilling a section of well bore, the drill string and the drill bit are pulled out of the wellbore and a section of casing is deployed and cemented into place to create the desired isolation from the newly drilled formation.

In well construction it is often necessary to alter an existing wellbore trajectory. This is typically called "side-tracking". Scenarios that may require side-tracking include, but are not limited to, a need to avoid subsurface hazards (faults, shallow gas, etc.), planned multi-lateral wells, failure of an existing wellbore, missed geological targets, and reuse of an existing wellbore that has depleted reservoir production. A whipstock is a device that is commonly deployed to facilitate the altering of a wellbore trajectory. The whipstock has a longitudinal tubular body with an inclined plane that when deployed into the wellbore can serve as a deflection surface or ramp to alter the trajectory of the drill bit and, thus, the wellbore.

Typically, a whipstock is deployed and set at a predetermined "casing window" or "side-track" depth inside the wellbore either within a casing section or section without casing referred to as an open hole section. The mechanism that anchors the whipstock and isolates the wellbore section below can be either permanent (cement) or retrievable (slips, seals, elastomeric element). In operation, a mill bit or drill bit is often integrated with the whipstock and deployed as an assembly. This permits the milling of a window in the casing, or open hole, to commence immediately following the setting of the whipstock. Typically, the milling operation includes milling a window in the casing and a short section of new formation before the mill bit is changed out for a drill bit that is better suited for drilling longer formation sections. Upon completion of drilling operations, the whipstock is retrieved by a dedicated trip into the wellbore with a dedicated whipstock retrieval tool, which is a separate assembly from the mill bit or drill bit.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in one or more embodiments, a retrievable whipstock assembly and a method for installing and retrieving a whipstock in a wellbore. The retrievable whipstock assembly for a wellbore includes a whipstock including a longitudinal body and an anchor connection, a deflection surface provided on the longitudinal body with a first engagement element, and a drilling assembly including a drill housing and a second engagement element. The second engagement element is selectively extendible between a recessed position and an extended position. In the extended position the second engagement element is engageable with the first engagement element.

The method of installing and retrieving a whipstock in a wellbore includes, in one or more embodiments, fitting a whipstock to a drilling assembly to form a retrievable whipstock assembly. The method further includes deploying the retrievable whipstock assembly into the wellbore, anchoring the whipstock in the wellbore at a setting depth, and releasing the drilling assembly. In addition, the method includes drilling a lateral wellbore section with the drilling assembly, pulling a drill string out of the wellbore lateral section, extending a selectively extendable second engagement element on the drilling assembly, engaging the second engagement element with a first engagement element, and applying an upward tension on the whipstock to release the whipstock from the wellbore. Finally, the method includes removing the drilling assembly and the whipstock from the wellbore together.

Other aspects and advantages of the claimed subject matter will be apparent from the following description and the appended claims.

DETAILED DESCRIPTION

In the following detailed description of embodiments of the disclosure numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to a whipstock retrieval assembly that supports the deployment and recovery of a retrievable whipstock without the need for a dedicated retrieval tool or a dedicated trip into the wellbore. This saves the operator time and cost by reducing the number of trips into the wellbore. Typically, a whipstock is set at a predetermined depth inside an oil & gas wellbore creating a deflection surface or ramp for the bit to change the wellbore trajectory and drill a new wellbore section. When drilling has been completed and it has been decided that the whipstock will be recovered, a separate dedicated trip into the wellbore with a dedicated retrieval tool is required. This additional trip into the wellbore can be a time-consuming operation, especially for deeper or extended reach wellbores, which can translate to a high-cost operation when factoring in rig day rates and daily rates of other services supporting the overall well construction operation.

Figure 1:
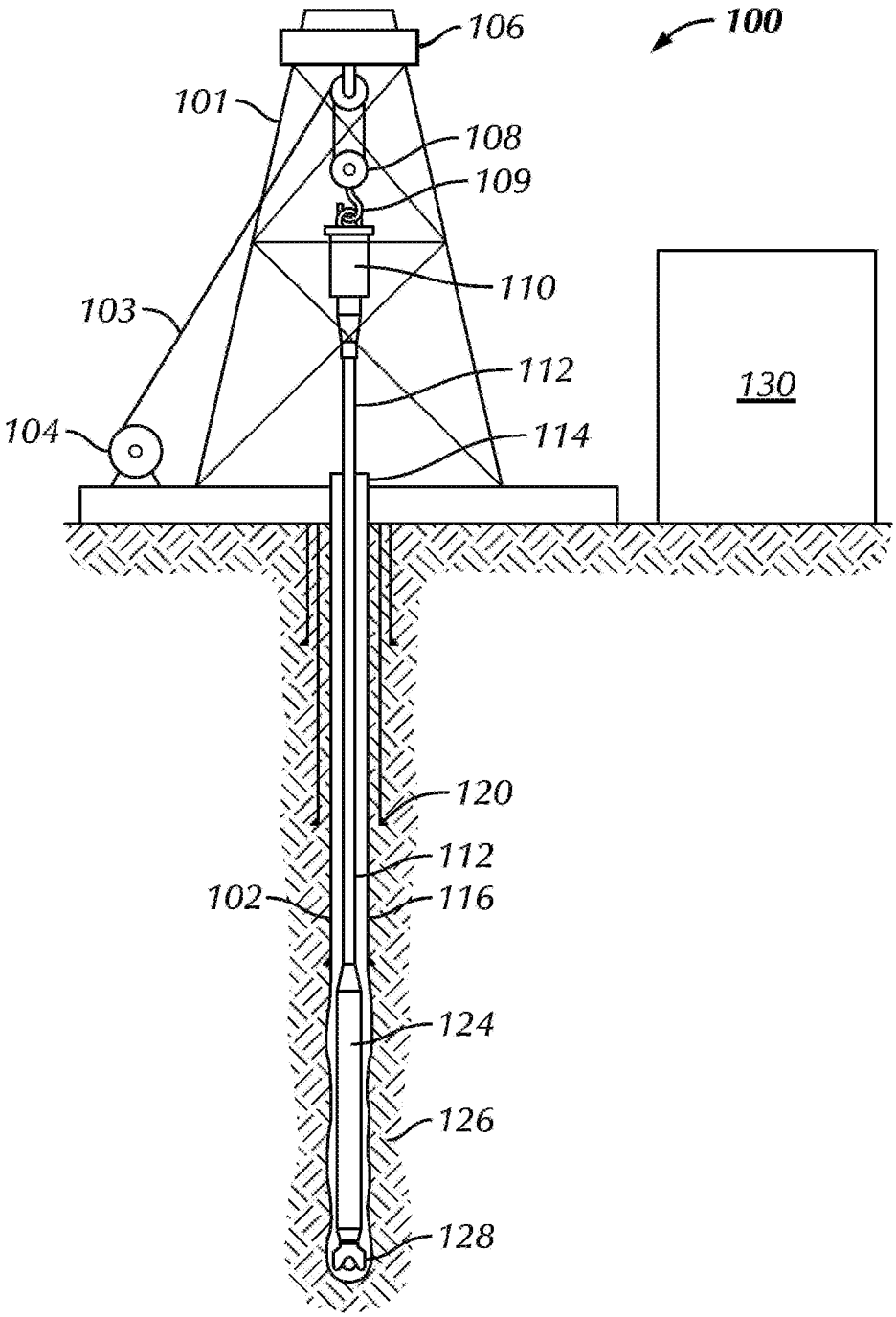
FIG. 1 illustrates an example drilling rig and wellbore.

FIG. 1 illustrates an example well site (100). In general, well sites may be configured in a myriad of ways. Therefore, the well site (100) is not intended to be limited with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (126). For the purpose of drilling a new section of wellbore (102), a drill string (112) is suspended within the wellbore (102). The drill string (112) may include one or more drill pipes connected to form conduit and a bottom hole assembly (BHA) (124) disposed at the distal end of the conduit. The BHA (124) may include a drill bit (128) to cut into the subsurface rock. The BHA (124) may include measurement tools, such as a measurement-while-drilling (MWD) tool or a logging-while-drilling (LWD) tool (not shown), as well as other drilling tools that are not specifically shown but would be understood to a person skilled in the art.

The drill string (112) may be suspended in wellbore (102) by a derrick structure (101). A crown block (106) may be mounted at the top of the derrick structure (101). A traveling block (108) may hang down from the crown block (106) by means of a cable or drill line (103). One end of the drill line (103) may be connected to a drawworks (104), which is a reeling device that can be used to adjust the length of the drill line (103) so that the traveling block (108) may move up or down the derrick structure (101). The traveling block (108) may include a hook (109) on which a top drive (110) is supported. The top drive (110) is coupled to the top of the drill string (112) and is operable to rotate the drill string (112). Alternatively, the drill string (112) may be rotated by means of a rotary table (not shown) on the surface (114). Drilling fluid (commonly called mud) (not shown) may be pumped from a mud system (130) into the drill string (112). The mud may flow into the drill string (112) through appropriate flow paths in the top drive (110) or through a rotary swivel if a rotary table is used (not shown). Details of the mud flow path have been omitted for simplicity but would be understood a person skilled in the art.

During a drilling operation at the well site (100), the drill string (112) is rotated relative to the wellbore (102) and weight is applied to the drill bit (128) to enable the drill bit (128) to break rock as the drill string (112) is rotated. In some cases, the drill bit (128) may be rotated independently with a drilling motor (not shown). In other embodiments, the drill bit (128) may be rotated using a combination of a drilling motor (not shown) and the top drive (110) (or a rotary swivel if a rotary table is used instead of a top drive) to rotate the drill string (112). While cutting rock with the drill bit (128), mud (not shown) is pumped into the drill string (112). The mud flows down the drill string (112) and exits into the bottom of the wellbore (102) through nozzles in the drill bit (128). The mud in the wellbore (102) then flows back up to the surface (114) in an annular space between the drill string (112) and the wellbore (102) carrying entrained cuttings to the surface (114). The mud with the cuttings is returned to the mud system (130) to be circulated back again into the drill string (112). Typically, the cuttings are removed from the mud, and the mud is reconditioned as necessary, before pumping the mud again into the drill string (112).

Drilling operations are completed upon the retrieval of the drill string (112), the BHA (124), and the drill bit (128) from the wellbore (102). In some embodiments of wellbore (102) construction, the production casing operations may commence. A casing string (116), which is made up of one or more larger diameter tubulars that have a larger inner diameter than the drill string (112) but a smaller outer diameter than the wellbore (102), is lowered into the wellbore (102) on the drill string (112). Generally, the casing string (116) is designed to isolate the internal diameter of the wellbore (102) from the adjacent formation (126). Once the casing string (116) is in position, it is set and cement is pumped down through the internal space of the casing string (116), out of the bottom of the casing shoe (120), and into the annular space between the wellbore (102) and the outer diameter of the casing string (116). This secures the casing string (116) in place and creates the desired isolation between the wellbore (102) and the formation (126). At this point, drilling of the next section of the wellbore (102) may commence.

In one or more embodiments, a whipstock may be deployed when there is a need to alter the trajectory of the wellbore. In one or more embodiments a whipstock includes a lower anchoring mechanism, an inclined deflection surface, and a releasable connection to the drilling assembly located at the top of the whipstock. The lower anchoring mechanism may be a hydraulic or mechanical anchor configured to be removable following a drilling operation, while the releasable connection may be a shear pin or equivalent shearing connection. During whipstock operations the whipstock, a drilling assembly, and a bit are deployed into the wellbore as an assembly. Upon reaching the planned setting depth, the anchoring mechanism is activated and attaches the whipstock to the inside surface of the wellbore casing.

Next, the releasable connection is severed by applying a downward force to the whipstock from the drill string, thereby releasing the drilling assembly and the bit from the whipstock. With the drilling assembly and bit now freed from the whipstock, drilling can commence. Alternatively, the whipstock may be deployed in the wellbore by a separate running tool (not shown) such that the whipstock is anchored in the wellbore without being attached to the drilling assembly. In either configuration, once placed, the whipstock is anchored in the wellbore independent of the drilling assembly such that the drilling assembly moves freely within the wellbore.

As the bit begins drilling, the deflection surface of the whipstock is used as a ramp to deflect the bit away from the existing wellbore so as to commence drilling of a new wellbore with a new trajectory. After the new wellbore has been drilled, and while the bit is still in the wellbore, embodiments of the present disclosure provide the ability to retrieve the whipstock as the bit is being pulled out of the wellbore without the need for a second trip. In one or more embodiments, the present disclosure describes an apparatus and process for engaging the whipstock with the bit as the bit is being pulled back to surface. This allows the whipstock to be retrieved without a dedicated trip into the wellbore with a dedicated whipstock retrieval tool.

Figure 2A:
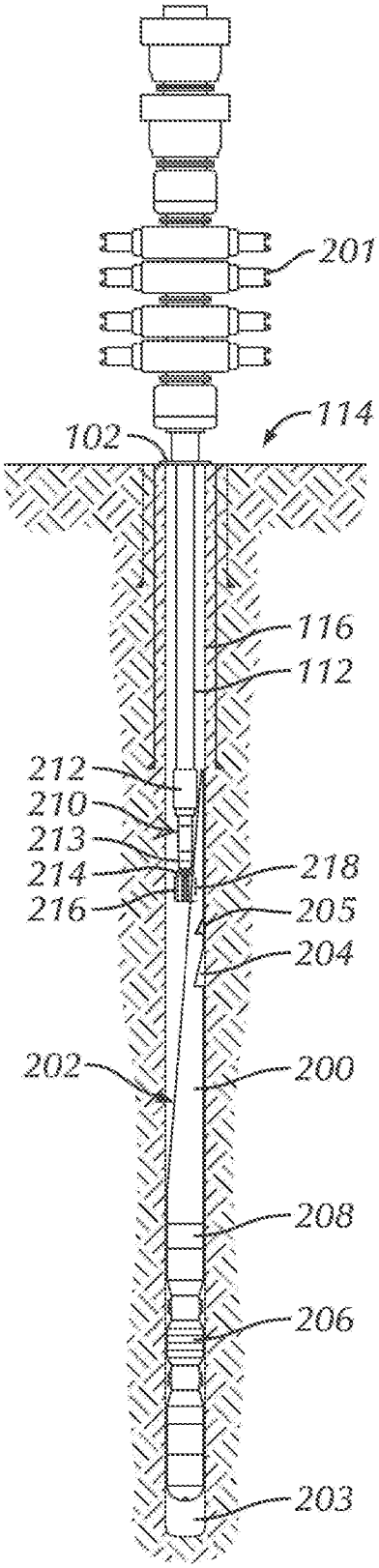
FIGS. 2A-2C show diagrams depicting the operational sequence of setting and retrieving a whipstock in accordance with one or more embodiments.
Figure 2B:
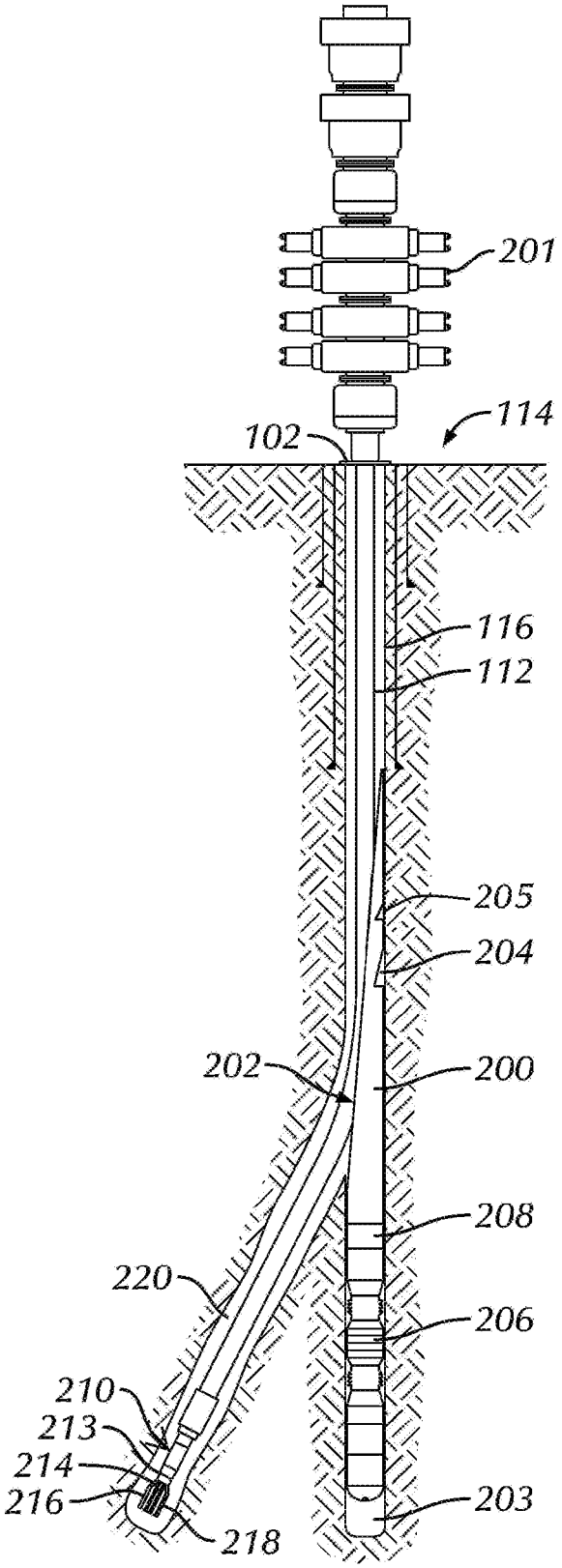
Figure 2C:
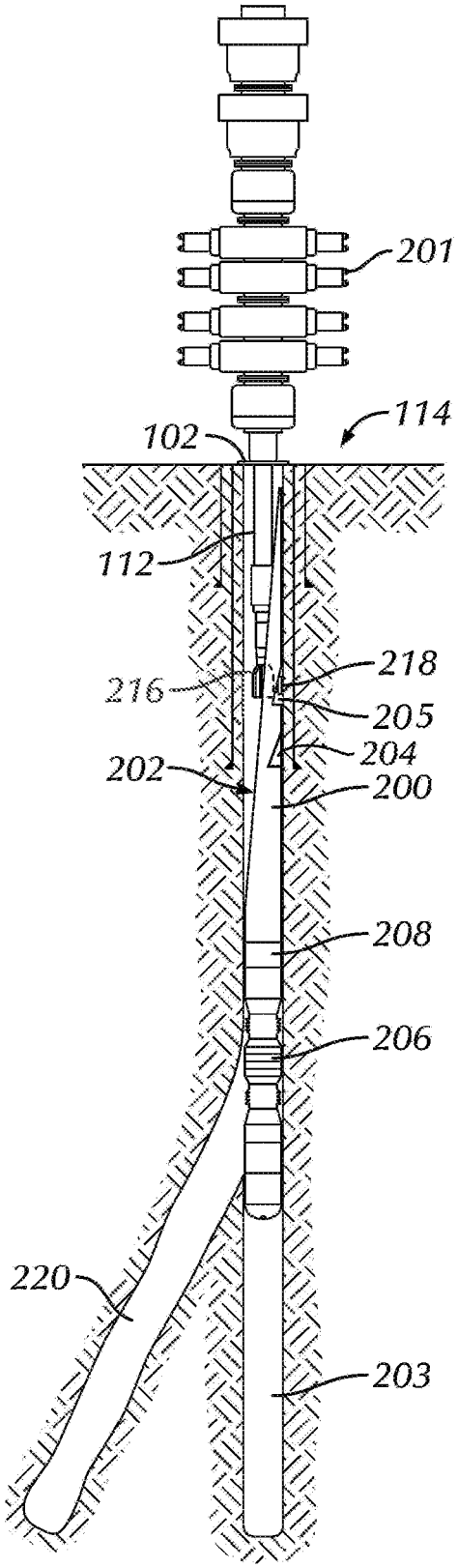

FIGS. 2A-2C provide an overview of an operational sequence in accordance with one or more embodiments of the present disclosure. FIG. 2A depicts a whipstock (200) that has been deployed on drill string (112) and anchored to the casing string (116) of the mainbore (203) in a wellbore (102), which has a Blowout Preventer (BOP) (201) installed. The BOP (201) is considered safety critical equipment and is typically installed during whipstock operations while drilling a new wellbore section. The whipstock (200) includes a deflection surface (202), a connection to an anchor (206) via an anchor connection (208), and a first engagement element. The deflection surface (202), often referred to as a "whipface" in industry, is an inclined, concave-shaped bar used to deflect a mill bit (216).

The mill bit (216) may be a fixed-style bit that is designed for milling through metal or steel. This type of bit is commonly used in the oil and gas industry for milling a window in the casing string (116) when there is a need to 'sidetrack' or change the trajectory of a wellbore (102). The mill bit (216) is commonly constructed from tungsten carbide, however one of ordinary skill in the art would appreciate that a mill bit (216) may be constructed from steel, a high strength alloy, and have a bonded polycrystalline diamond (PDC) layer.

In one or more embodiments, the first engagement element is a slot (205) located on the deflection surface (202) of the whipstock (200). The slot (205) extends radially through the deflection surface (202) of the whipstock (200) and is used as an engagement point when the whipstock (200) is to be retrieved. In addition, the whipstock (200) includes a cutout (204) extending through the deflection surface (202) of the whipstock (200) that is configured to engage with a dedicated retrieval tool (not shown) according to current methods of retrieval known to one of ordinary skill in the art. To this end, current methods of retrieving a whipstock (200) include engaging a hook (not shown) or other engagement device of a dedicated retrieving tool (not shown) with the cutout (204) after a sidetracking operation has been completed and the trajectory of the wellbore (102) has been changed.

In addition, FIG. 2A shows a drilling assembly (210) that is connected to the whipstock (200) via a drilling assembly connector (212). The drilling assembly connector (212) may be a force-limiting type connection that is designed to fail upon the application of a predetermined amount of applied force, such as a shear pin, magnetic interlock, or other equivalent connection known to one of ordinary skill in the art. Alternatively, and as described above, the whipstock (200) may be deployed in the wellbore (102) prior to a drilling operation. In this case, the whipstock (200) is deployed by a separate running tool or assembly (not shown). After the whipstock (200) is deployed, the running tool or assembly (not shown) is then removed from the wellbore (102) before the drilling operation commences.

The drilling assembly (210) includes a bottom hole assembly (BHA) connection (213), a drilling housing (214), the mill bit (216), and a second engagement element. In one or more embodiments, the second engagement element is a pad (218). The pad may be actuated hydraulically, electrically, electro-hydraulically, or by another means known to one of ordinary skill in the art. The pad (218) is embedded into the mill bit (216) and may be selectively shifted from a recessed position to an extended position. In order to actuate the pad (218), in accordance with some embodiments, hydraulic pressure may be supplied to the base of the pad (218) via drilling fluid being pumped down the internal diameter of the drill string (112) causing the pad to shift from the recessed position to the extended position. To achieve the required hydraulic force, the drilling fluid flow rate may be increased, or a physical barrier may be placed at the nozzles of the mill bit, which is oriented below the pad (218). This physical barrier or obstruction may be, for example, a ball that is dropped from surface or other means known to one of ordinary skill in the art. The physical barrier or obstruction would reduce the total flow area causing the pressure applied to the pad (218) to shift to the extended position. While in the extended position, upon retrieval, the pad (218) engages with the slot (205) of the whipstock (200) creating a connection that may be used to retrieve the whipstock (200) from the mainbore (203) without necessitating a second trip or a dedicated retrieval tool. In addition, one of ordinary skill in the art would appreciate that the mill bit (216) may be a drill bit when the wellbore (102) is not cased, meaning the casing string (116) is not present.

FIG. 2B shows the milling operations of a lateral (220) of the wellbore (102) in accordance with one or more embodiments. The drilling assembly connector (212) of FIG. 2A, which may be a shear pin or other shearing device, has been sheared by applying a downward force to release the drilling assembly (210) from the anchored whipstock (200). Upon being redirected by the deflection surface (202) of the whipstock (200), the mill bit (216) has milled a window in the casing string (116) and has departed the mainbore (203) and re-oriented the trajectory of the wellbore (102) into the lateral (220).

FIG. 2C depicts retrieval of the whipstock (200) in accordance with one or more embodiments. The mill bit (216) has been pulled out of the lateral (220) and back into the mainbore (203) in close proximity to the slot (205) of the whipstock (200). The drilling assembly (210) is oriented to align the pad (218) of the drilling assembly (210) with the slot (205) of the whipstock (200). As described above, in one or more embodiments, the pad (218) is actuated by hydraulic pressure that is applied to the base of the pad which shifts the pad (218) from the recessed position to the extended position. In the extended position, the pad (218) is able to engage the slot (205). With the whipstock (200) and drilling assembly (210) now connected through the slot (205) and the pad (218), the anchor (206) may be released thereby disconnecting the whipstock (200) from the casing string (116). The whipstock is now in a position to be pulled out of the wellbore (102) with the drilling assembly (210) and recovered at the surface (114). Alternatively, the whipstock (200) may be removed from the wellbore (102) by engaging a dedicated retrieval tool (not shown) with a cutout (204) of the whipstock and pulling the whipstock (200) from the wellbore (102).

Figure 3A:
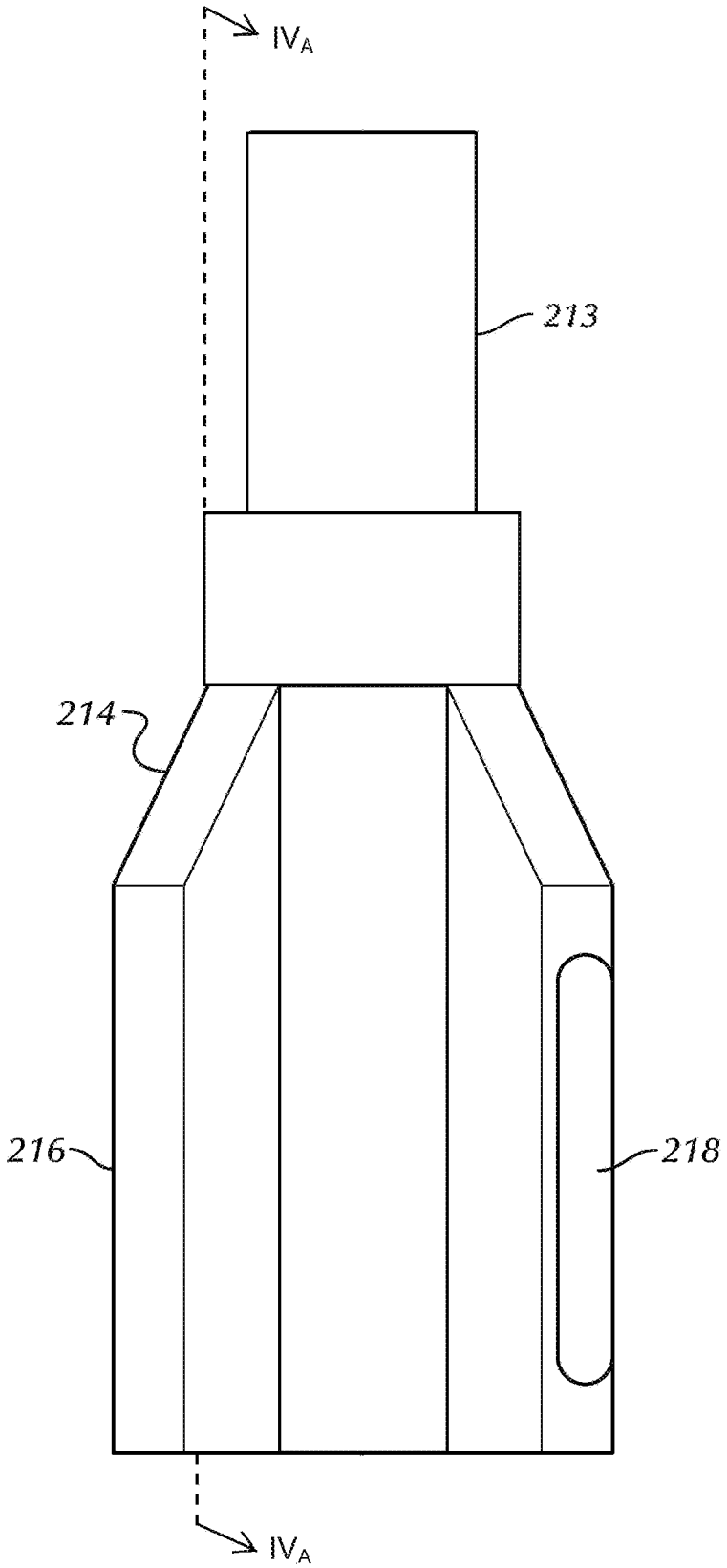
FIGS. 3A-3B are side views showing a bit in accordance with one or more embodiments.

FIG. 3A shows a mill bit (216) with the pad (218) integrated into a drilling housing (214) in accordance with one or more embodiments. A drilling housing (214) includes a body portion of the mill bit (216), a BHA connection (213), and the pad (218). The BHA connection (213) connects the drilling housing (214) to the drilling assembly (210) depicted in FIGS. 2A-2C and may be, for example, a threaded connection as is known in the art. The pad (218), in this embodiment, is integrated into the drilling housing (214) and is in a recessed position. The pad (218) may have a shape that is elongated, rounded, triangular, or tapered, with or without a protruding brim, edge, lip, or a ridge located at the top edge of the pad (218). In addition, the pad (218) may be of a hook-shaped design to help facilitate the engagement with the whipstock (200). Finally, the pad may be constructed of a high strength steel, alloy, or equivalent, and have a tungsten or PDC coating similar to the mill bit (216).

Figure 3B:
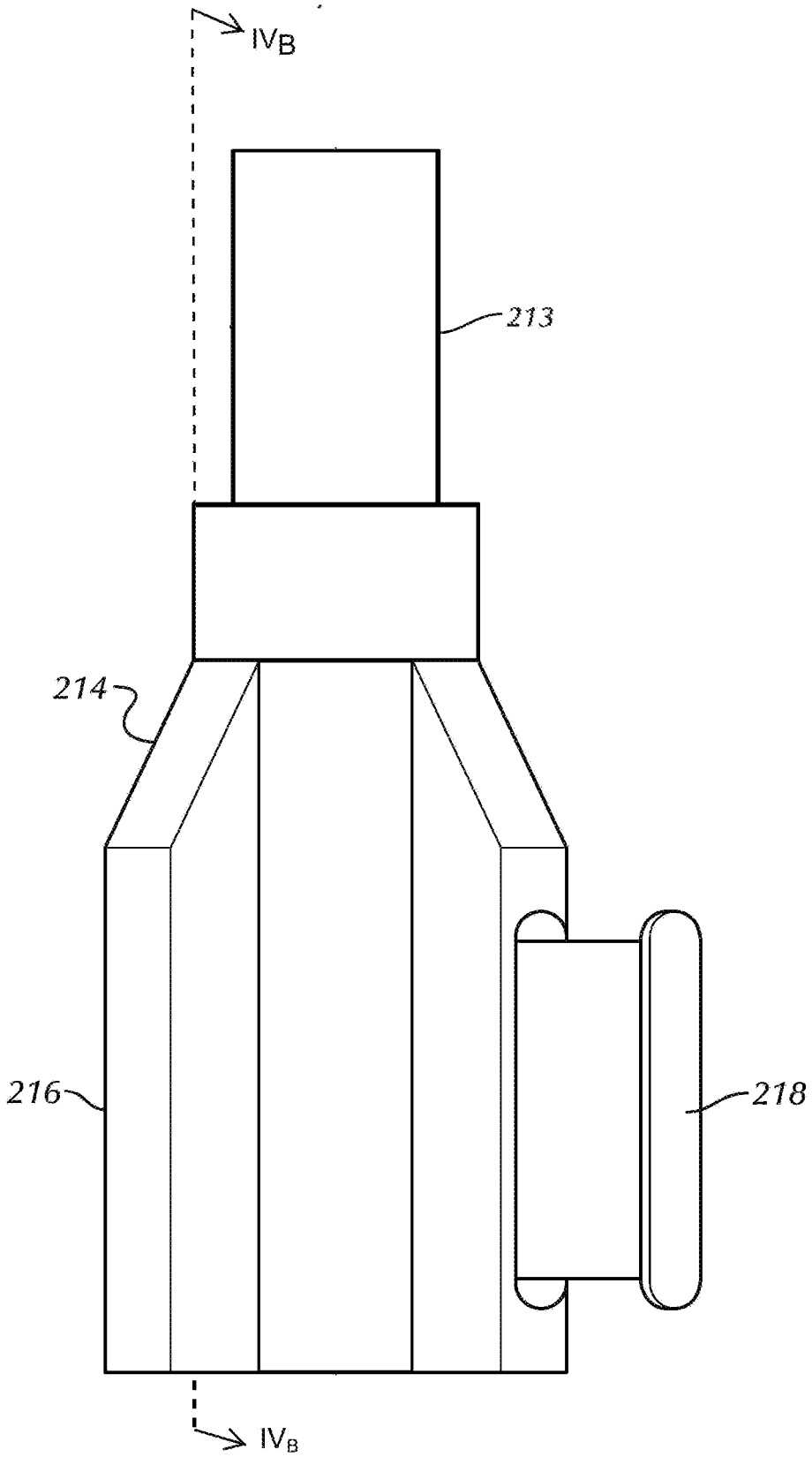

As depicted in FIG. 3B, in one or more embodiments, the pad (218) is designed to shift from a recessed position to an extended position when actuated. The extended position is when the pad (218) extends laterally beyond the profile of the drilling housing (214). As described below, the pad (218) may be actuated hydraulically, electrically, electro-hydraulically or by another means known to one of ordinary skill in the art.

Figure 4A:
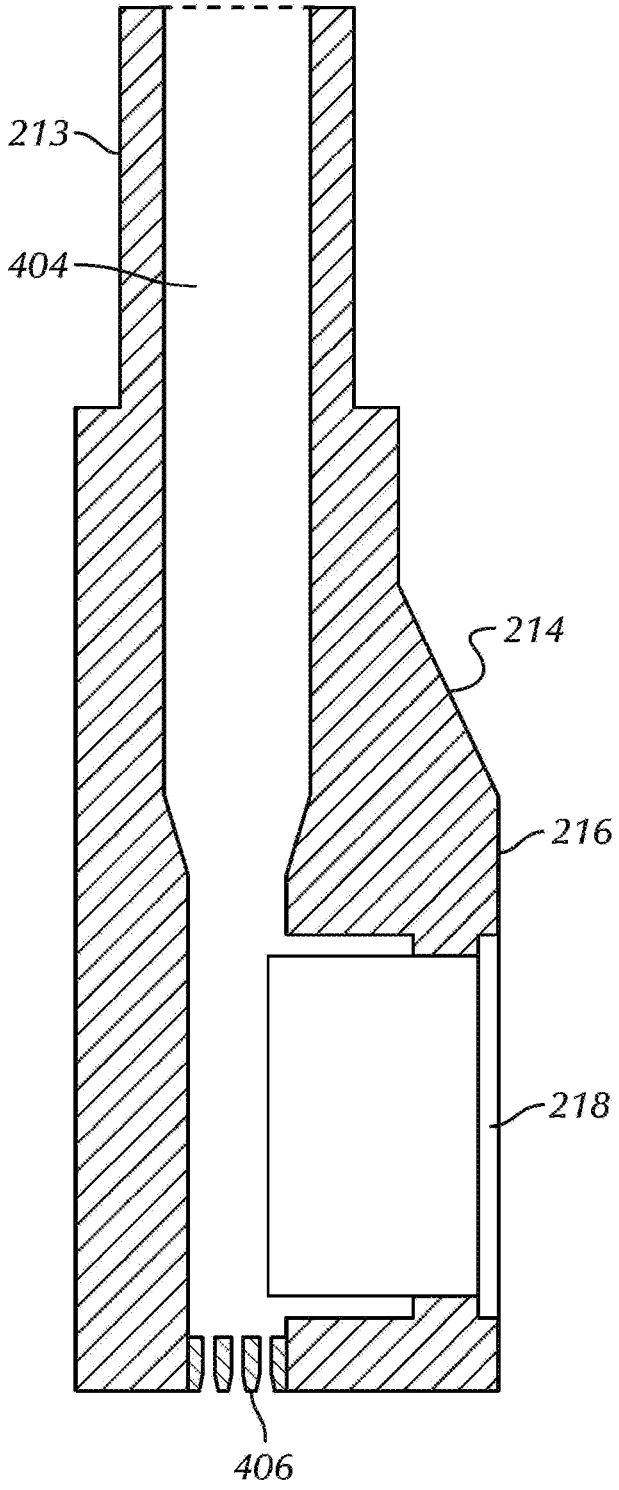
FIG. 4A is a cross-sectional view taken along the line $IV_A$ - $IV_A$ of FIG. 3A in accordance with one or more embodiments.

FIG. 4A depicts a cross-sectional view of the mill bit (216) of FIG. 3A with the pad (218) in the recessed position. To prevent the pad (218) from being further pushed back into the drilling housing (214), the pad (218) is sized such that the pad (218) abuts against the drilling housing (214) when not extended. This feature may be embodied as a sleeve that is dropped down the drilling housing bore (404) to prevent the pad from being pushed too far into the drilling housing (214). The mill bit (216) also includes a nozzle (406) configured to allow fluid communication between the drilling housing bore (404) and the wellbore (102). The nozzle (406) may embodied as one or more orifice(s) that extend from the drilling housing bore (404) to the wellbore (102).

Figure 4B:
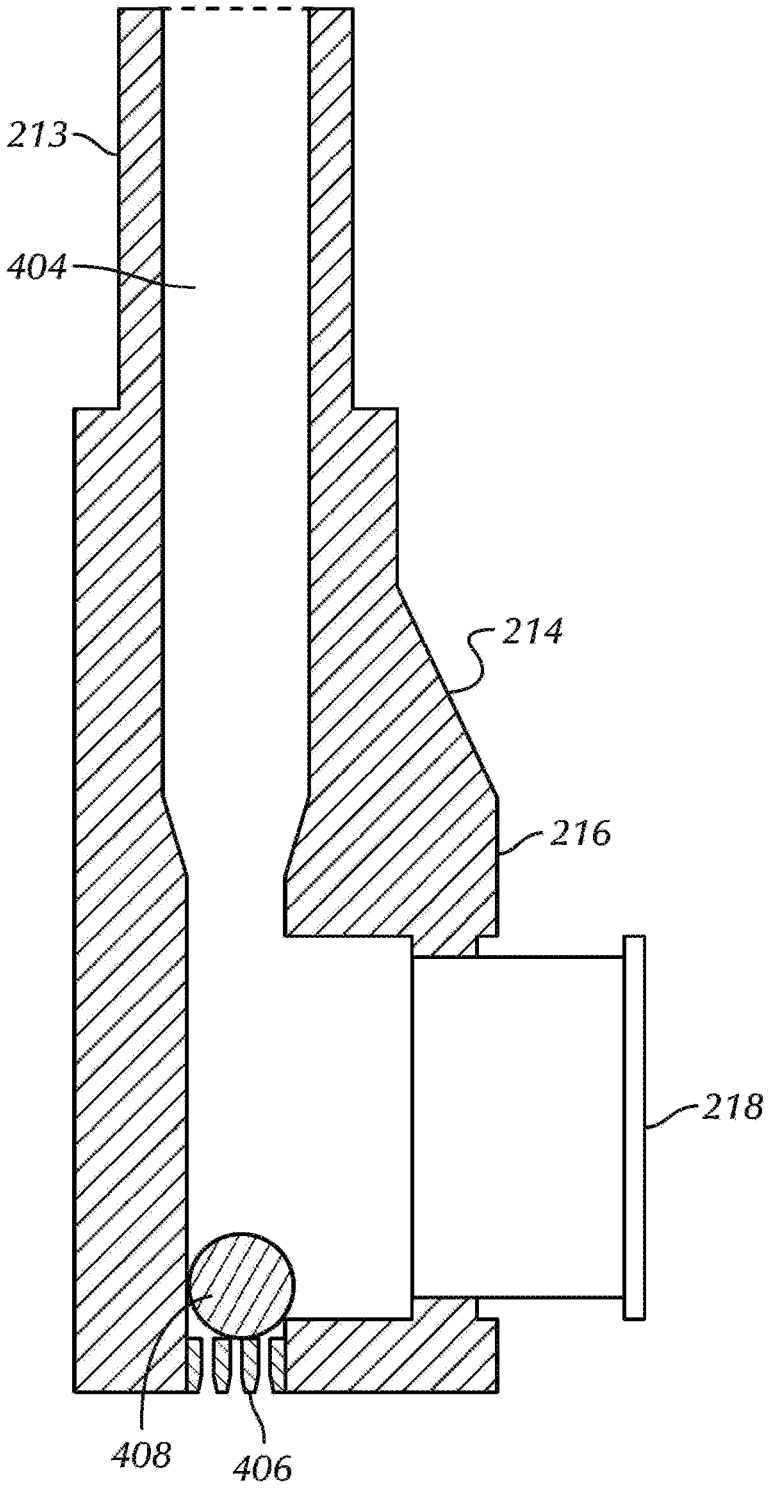
FIG. 4B is a cross-sectional view taken along the line $IV_B$ - $IV_B$ of FIG. 3B in accordance with one or more embodiments.

FIG. 4B depicts a cross-sectional view of the mill bit (216) as shown in FIG. 3B with the pad (218) in the extended position. In one or more embodiments, to actuate the pad (218), hydraulic pressure would be applied from the surface (114) through the inside of the drill string (112) and inside the drilling housing bore (404) to extend the pad (218) from a recessed position to the extended position. As described above, this may be achieved by increasing the fluid flow rate across the mill bit (216). However, if there is insufficient pressure envelope available, then achieving the required hydraulic pressure may be accomplished by dropping one or more ball(s) (408) into the bore effectively sealing the nozzle (406) in the mill bit (216).

The ball (408) may be configured to seal one or more nozzles (406) of the mill bit (216), and may be formed of a high strength steel, alloy, or equivalent. As fluid is pumped through the drilling housing bore (404), the fluid cannot exit through the nozzle (406), and hydraulic pressure builds in the drilling housing bore (404) and pad (218). Once a sufficient hydraulic pressure has developed, the hydraulic pressure acting on the pad (218) causes the pad (218) to release from the mill bit (216) and shift to the extended position. The pad (218) remains extended due to the hydraulic pressure and can engage a slot (205) of the whipstock (200).

While certain embodiments for extension of the pad (218) have been described above, one of ordinary skill in the art would appreciate that shifting the pad (218) into the extended position may be accomplished in other ways within the scope of this disclosure. For example, the pad (218) may be extended by a spring, lever, or electromagnetic coil. Further, while obstruction of the nozzles (406) using a ball has been described above, other approaches to creating the necessary increased hydraulic pressure are within the scope of this disclosure. For example, a different type or shape of obstructing element may be used, or the nozzles (406) may be sealed by a valve (not shown) disposed in the drilling housing bore (404) downstream of the nozzles (406).

Figure 5A:
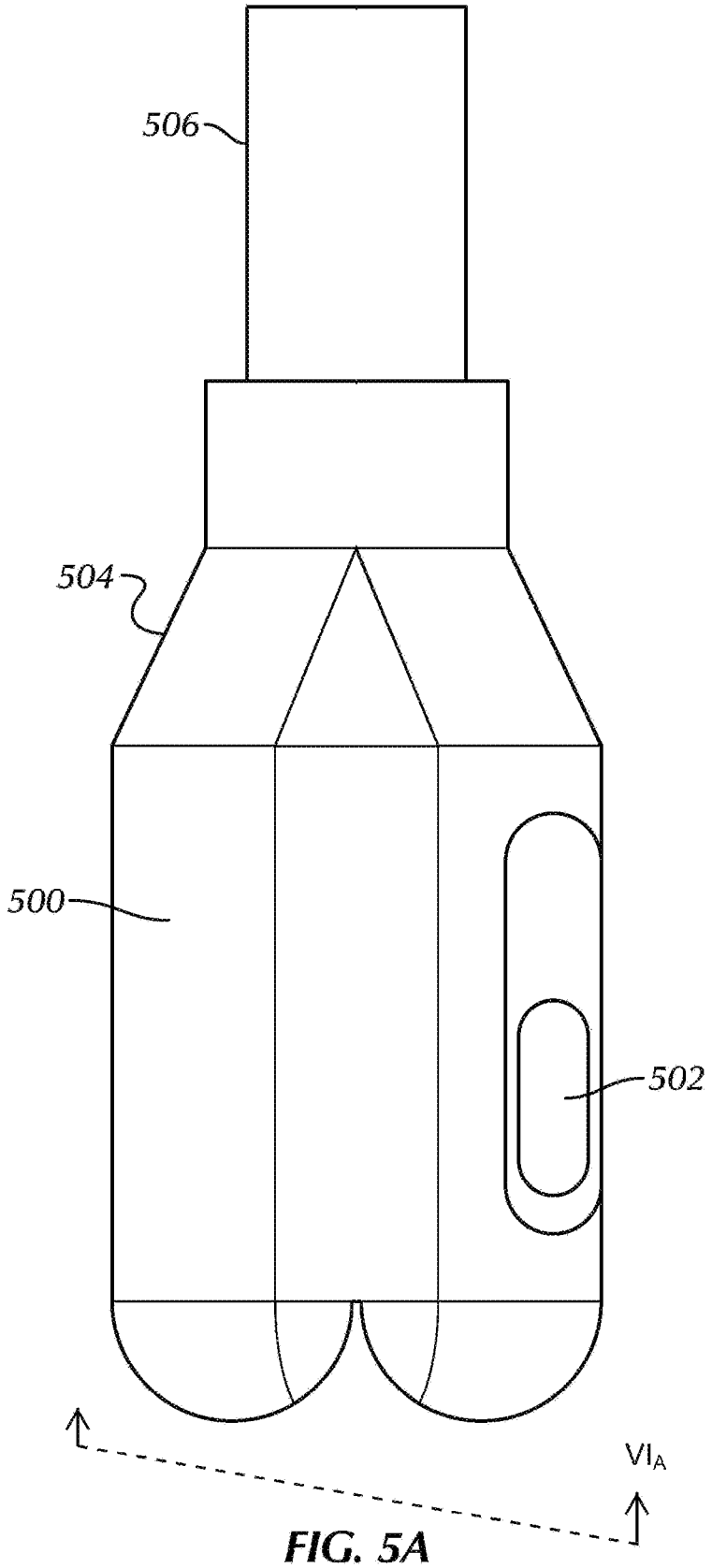
FIGS. 5A-5B are side views showing a bit in accordance with one or more embodiments.

FIG. 5A depicts, in one or more embodiments, a drill bit (500) with a pad (502) integrated into the drilling housing (504). The drill bit (500) is a fixed-style bit that is designed for drilling and cutting rock formations commonly used in the oil and gas industry for drilling new wellbore sections. This can be in a conventional wellbore (102) or in a lateral when there is a need to "sidetrack" or change the trajectory of a wellbore (102). The drill bit (500) is commonly constructed from tungsten carbide, however one of ordinary skill in the art would appreciate that a drill bit (500) may be constructed from other high strength alloys or steel. The drilling housing (504) herein refers to the body of the drill bit (500) and includes the BHA connection (506) and the pad (502). The BHA connection (506) may be a threaded connection or other type of connection adequate to secure the drill bit (500) and drilling housing (504) to the drilling assembly (210). The pad (502), in this embodiment, is integrated into the drilling housing (504) and is shown in a recessed position. The pad (502) may have a shape that is elongated, rounded, triangular, or tapered, with or without a protruding brim, edge, lip, or a ridge located at the top edge of the pad (502). In addition, the pad (502) may be of a hook-shaped design to help facilitate the engagement with the whipstock (200). The pad may be constructed of a high strength steel, alloy, or equivalent, and have a tungsten or PDC coating.

Figure 5B:
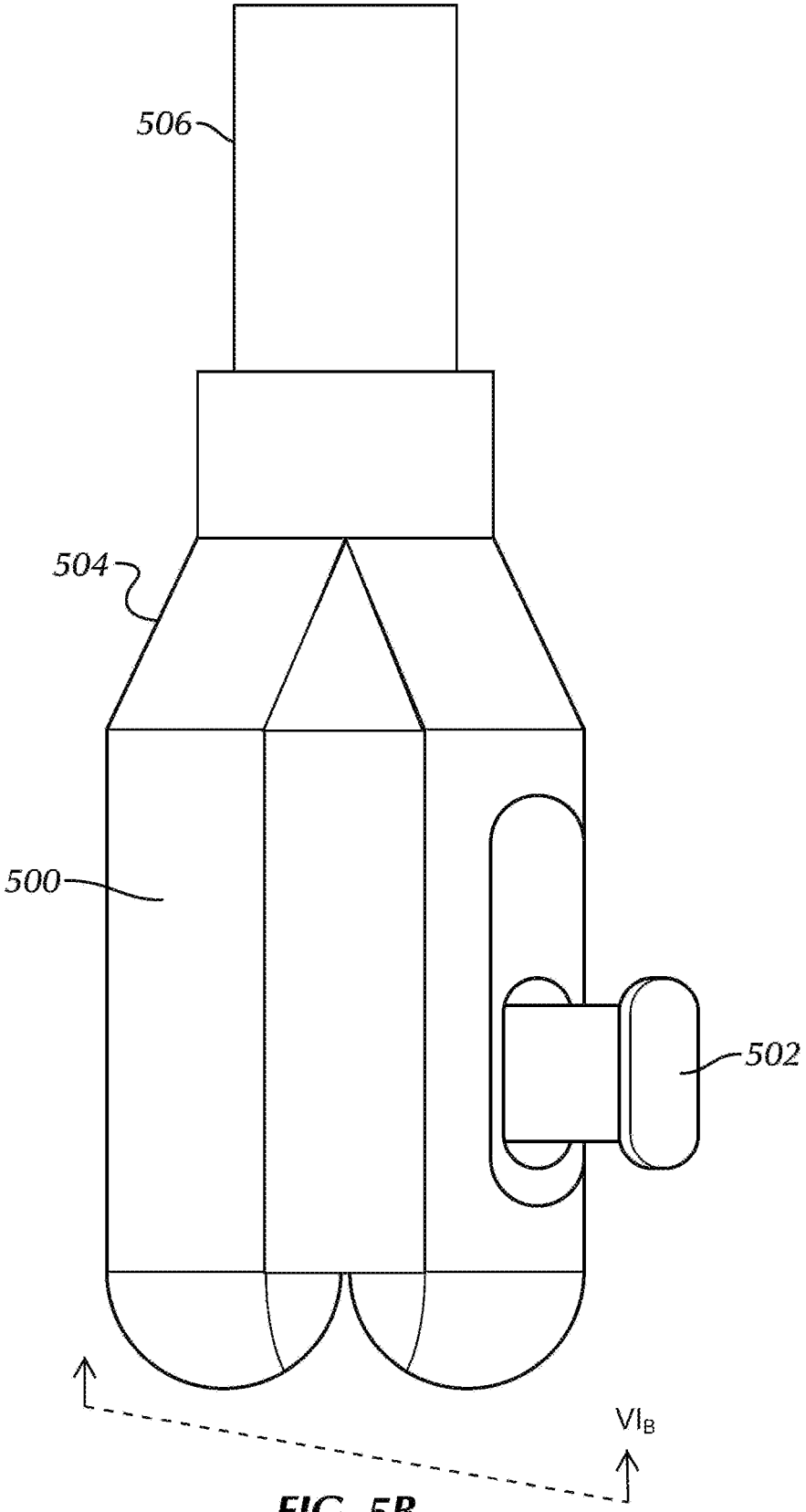

As depicted in FIG. 5B, in one or more embodiments, the pad (502) is designed to shift from a recessed position to an extended position when actuated. The extended position is when the pad (502) extends laterally beyond the profile of the drilling housing (504). As described below, the pad (502) may be actuated hydraulically, electrically, electro-hydraulically, or by another means known to one of ordinary skill in the art.

Figure 6A:
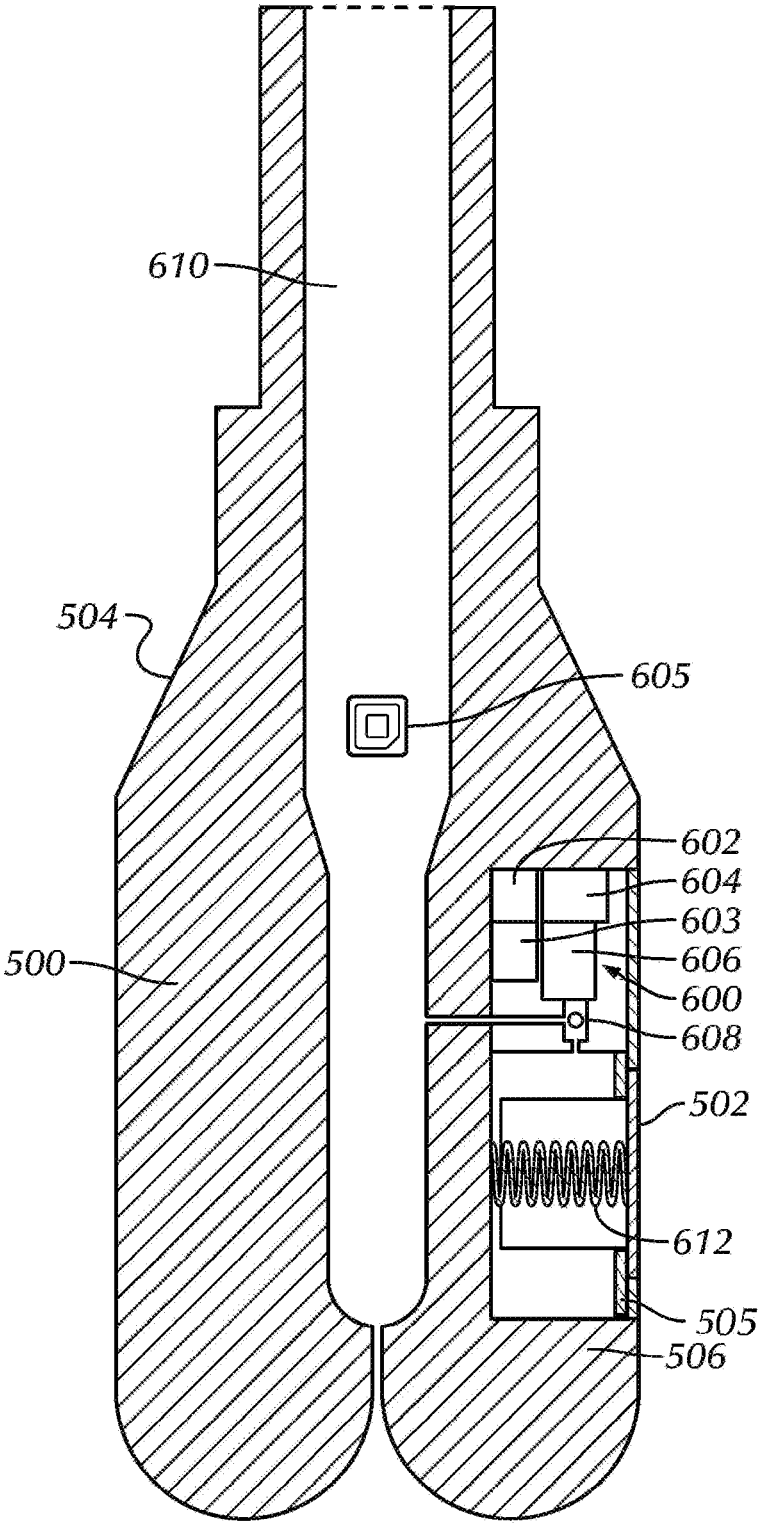
FIG. 6A is a cross-sectional view taken along the line $VI_A$ - $VI_A$ of FIG. 5A in accordance with one or more embodiments.

FIG. 6A depicts a cross-sectional view of the drill bit (500) of FIG. 5A with the pad (502) in the recessed position. In one or more embodiments, the pad (502) may be operatively controlled by an electronics module (600). The electronics module (600) may be integrated into the drilling housing (504) and positioned adjacent to the pad (502). In addition, the electronics module (600) may include a sensor (602), a battery (604), a motor (606), a processor (603), and a valve (608). The components of the electronics module (600) may be powered by the battery (604), which may be a lithium or alkaline battery. Alternatively, if power is available from another downhole source or from the surface, the battery may be omitted. The motor (606) may be a 90-degree servo motor, a DC motor, or equivalent, while the valve (608) may be a solenoid valve, a needle valve, or equivalent.

As seen in FIG. 6A, the drilling housing (504) includes a seal (505) configured to surround the pad (502). As the pad (502) extends from the drilling housing (504), the seal (505) prevents fluid from leaking from the drilling housing (504). The seal (505) may be formed of rubber, neoprene, or equivalent.

Figure 6B:
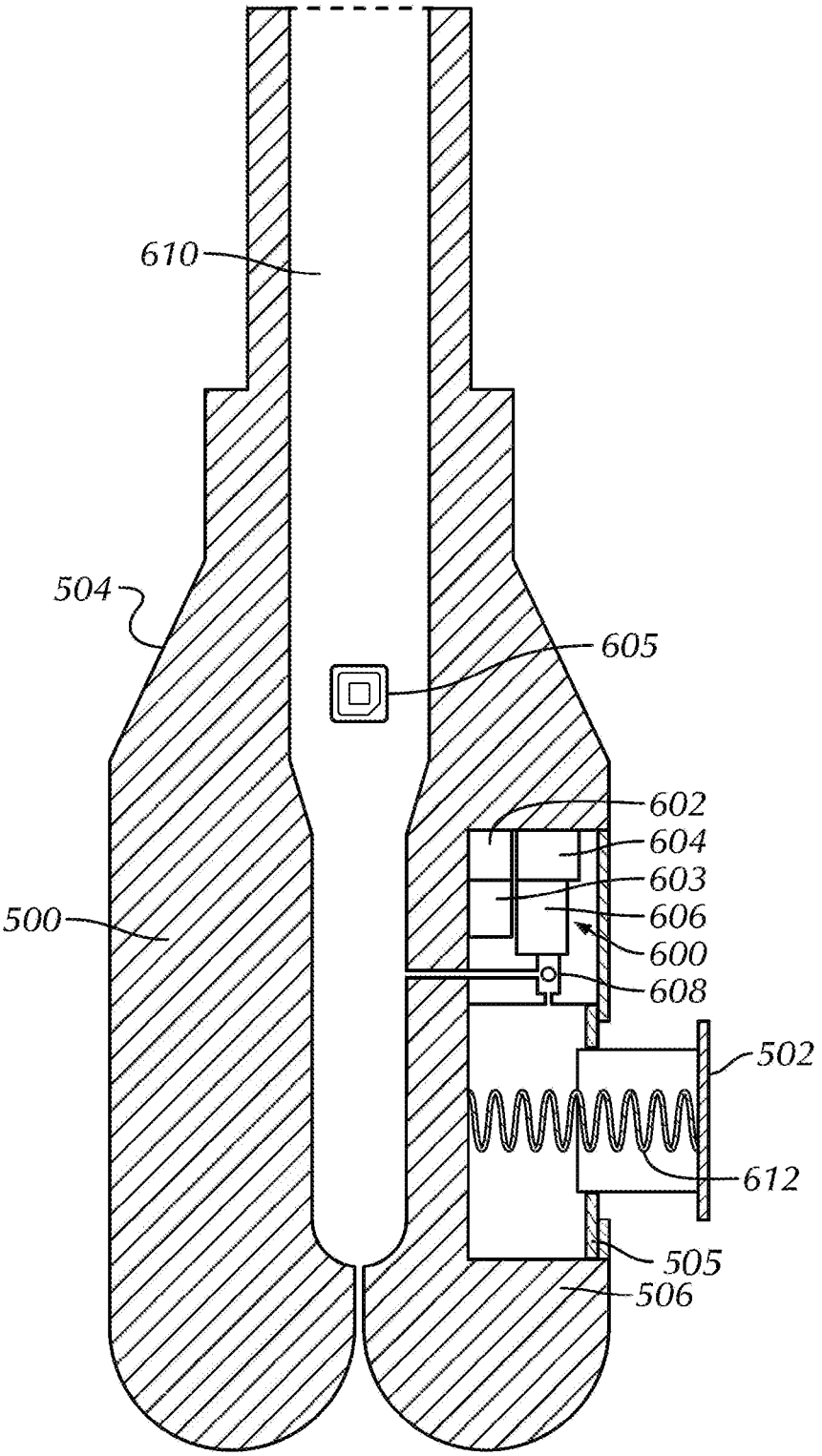
FIG. 6B is a cross-sectional view taken along the line $VI_B$ - $VI_B$ of FIG. 5B in accordance with one or more embodiments.

FIG. 6B depicts a cross-sectional view of the drill bit (500) of FIG. 5B with the pad (502) in the extended position. To actuate the pad (502), hydraulic pressure is applied from the surface (114) through the inside of the drill string (112) and inside the drilling housing bore (610). However, as shown in FIG. 6B, and in accordance with one or more embodiments, the fluid communication and resultant hydraulic pressure is controlled by the electronics module (600). This may be achieved by increasing the fluid flow rate across the mill bit (216). The fluid flow may be controlled by opening and closing the valve (608), which may be operatively controlled by the motor (606). To prevent fluid from leaking from the drilling housing (504), the drilling housing (504) includes a seal (505) disposed around the pad (502) such that the pad (502) extends through the seal (505) when in an extended position.

To actuate the motor (606), an activation device (605) may be pumped down the drilling housing bore (610) in the drilling fluid. The activation device (605) may be a radio frequency identification (RFID) tag, a Bluetooth low energy (BLE) beacon, magnet, or other device known to one of ordinary skill in the art. In each of these embodiments, the activation device (605) is configured to emit a signal that is sensed by the sensor (602). Upon sensing the signal from the activation device (605), the sensor (602) sends a signal to the processor (603), which sends an activation signal to the motor (606). The sensor (602) may be a RFID reader, a GSM chip, Hall effect sensor, or other device that is configured to detect the activation device (605) as it enters the drilling housing bore (610). In addition, the processor (603) may be a microprocessor or microcomputer configured to control the motor (606) and receive signals from the sensor (602). After the sensor (602) receives a signal from the activation device, the activation device exits the drill bit (500) and is returned to the surface with the drilling mud.

The drill bit (500) may further include a return spring (612). The return spring (612) may be fixed to the pad (502) and drilling housing (504) such that the pad (502) is retained within the drill bit (500) when the drill bit (500) is not in use. The return spring (612) may be disposed within the pad (502) or surround the pad (502). Alternatively, the pad (502) may be retained by an electromagnet that is controlled by the electronics module (600). In this embodiment, the electromagnet is active when the activation mechanism is not sensed by the sensor. However, when the activation mechanism is sensed, the electromagnet is deactivated, and the pad (502) is released.

Figure 7A:
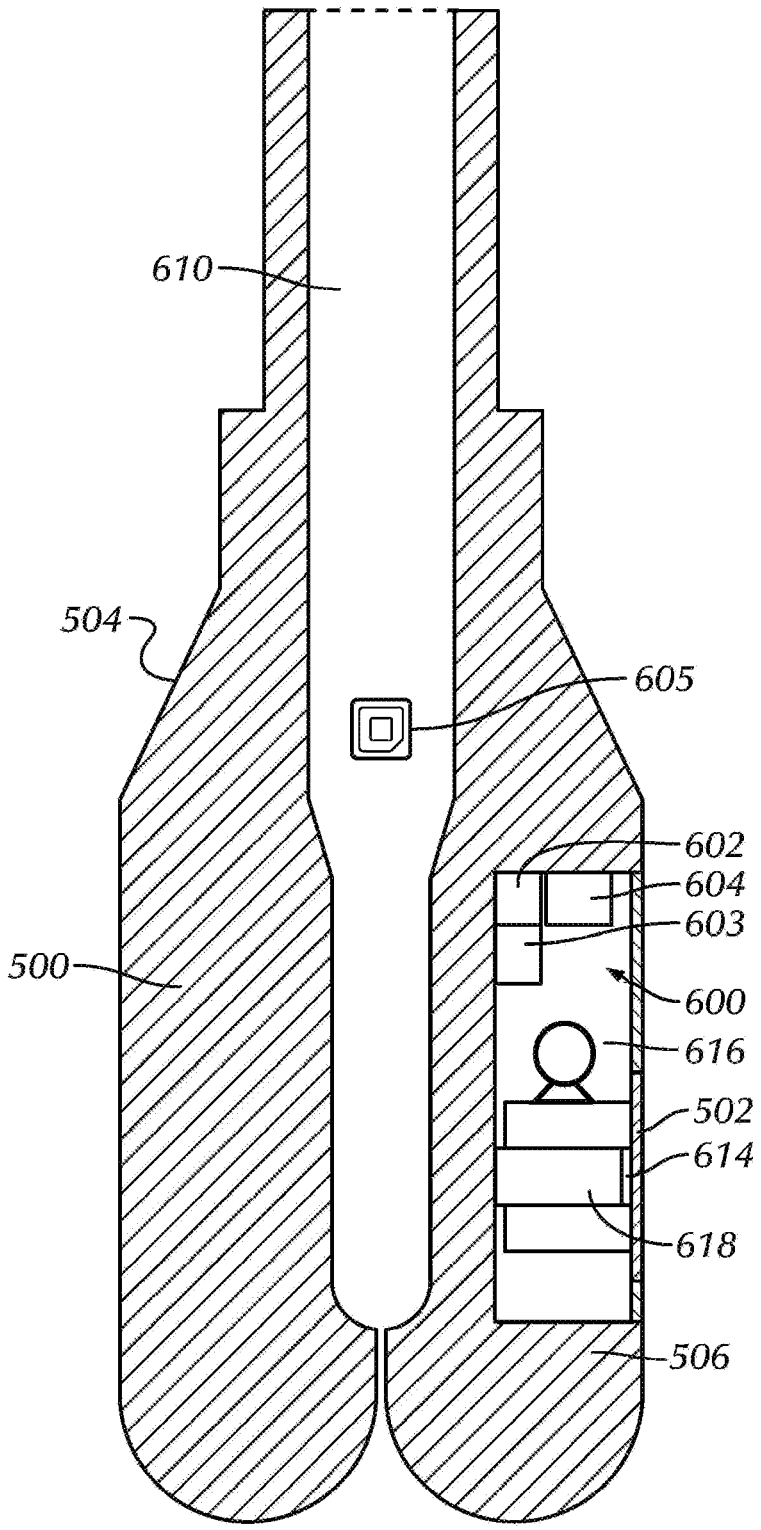
FIG. 7A is a cross-sectional view taken along the line $VI_A$ - $VI_A$ of FIG. 5A in accordance with one or more embodiments.
Figure 7B:
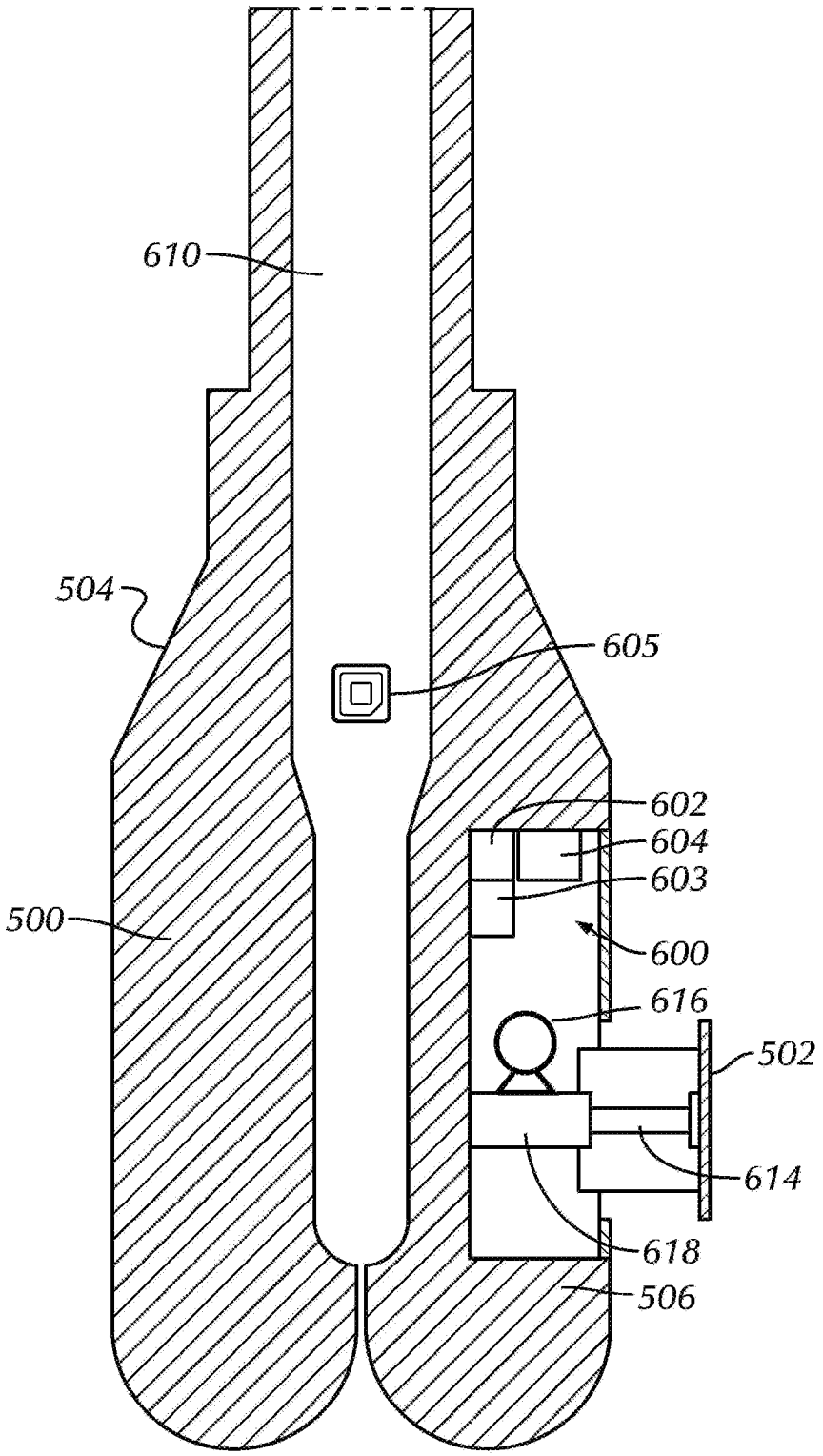
FIG. 7B is a cross-sectional view taken along the line $VI_B$ - $VI_B$ of FIG. 5B in accordance with one or more embodiments.

FIG. 7A and FIG. 7B depict an alternative method of extending the pad (502) using an electro-hydraulic actuator (618). In particular, FIG. 7A depicts a cross-sectional view of the drill bit (500) of FIG. 5A with the pad (502) in the recessed position, while FIG. 7B depicts a cross-sectional view of the drill bit (500) of FIG. 5B with the pad (502) in an extended position. As discussed above, the pad (502) may be operatively controlled by an electronics module (600), which is integrated into the drilling housing (504) and positioned adjacent to the pad (502). In this embodiment, the electronics module (600) includes a sensor (602), a battery (604), a processor (603), and an electro-hydraulic actuator (618). Each of these components are powered by the battery (604), as described above. In one or more embodiments, the electro-hydraulic actuator (618) includes a pump (616) that is operatively controlled by the processor (603). The pump (616) may be an electric pump, gear pump, or diaphragm pump that is configured to compress hydraulic fluid inside of the electro-hydraulic actuator (618). In addition, the electro-hydraulic actuator (618) includes an output shaft (614) that is fixed to the pad (502). The output shaft may be constructed from high strength steel, alloy, or equivalent, To actuate the pad (502), an activation device (605) may be pumped down the drilling housing bore (610) in the drilling fluid. The activation device (605) is configured to emit a signal that is sensed by the sensor (602). Upon sensing the signal from the activation device (605), the sensor (602) sends an opening command to the processor (603).

After receiving an opening command from the sensor (602), the processor (603) commands the electro-hydraulic actuator (618) to actuate the output shaft (614). In order to actuate the output shaft (614), the pump (616) compresses the hydraulic fluid, causing hydraulic pressure to build in the electro-hydraulic actuator (618). This hydraulic pressure is applied to the output shaft (614), which extends the output shaft (614), and thus the pad (502), into the extended position. Advantageously, this embodiment allows the whipstock (200) to be retrieved from the wellbore (102) without the need for drilling fluid to be pumped down the drilling housing bore (610).

Figure 8A:
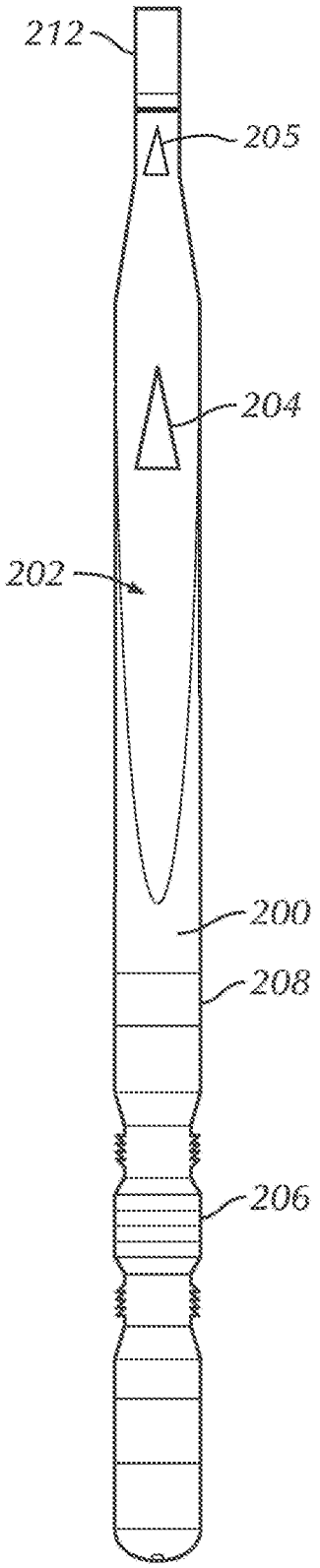
FIGS. 8A-8B are side views showing a retrievable whipstock assembly in accordance with one or more embodiments.

FIG. 8A depicts, in accordance with one or more embodiments, a whipstock (200). The whipstock includes a drilling assembly connector (212), an anchor connection (208), a deflection surface (202), and a slot (205). The drilling assembly connector (212) is located at the uppermost portion of the whipstock (200) and is configured to releasably connect the whipstock (200) to the drilling assembly (210). Typically, the whipstock (200) and the drilling assembly (210) are deployed into the wellbore (102) as an assembly. Upon setting the whipstock (200), the drilling assembly (210) is released from the whipstock, usually by applying a downward force which would shear a shear pin (not shown). The lower portion of the whipstock (200) includes the anchor connection (208). The anchor connection (208) is typically a hinge system design that connects the whipstock (200) to the anchor (206). The deflection surface (202) or "whipface" is a tapered, concave shaped, longitudinal bar located towards the upper portion of the whipstock (200) that is used to deflect the mill bit or drill bit to alter the trajectory of the wellbore (102). The deflection surface (202) includes an engaged element that, in this embodiment, is a slot (205). The slot (205) is designed to engage the pad (218) of the drilling assembly (210) as the drilling assembly (210) is being pulled out of the wellbore (102). In operation, the pad (218) engages the slot (205) and the whipstock (200) and the drilling assembly (210) are pulled out of the wellbore (102) together without requiring a dedicated trip into the wellbore (102). In some embodiments, the slot (205) is a slot formed in the deflection surface (202) that has a tapered shape. The tapered shape may be an elongated tapered shape, a triangular shape, a 'double point' shape, or other similar shape that permits the engagement between the slot (205) and the pad (218). The 'double point' shape may consist of an elongated slot that divides into two points at the end toward the top of the whipstock, which may be used with a similarly shaped pad (218).

The whipstock (200) may also include a cutout (204) that extends through the deflection surface (202) of the whipstock (200). This cutout (204) may be embodied as a tapered, oblong, or rounded shape and is configured to engage with a dedicated retrieval tool (not shown) if the whipstock is not removed using the slot (205) following a sidetracking operation.

Figure 8B:
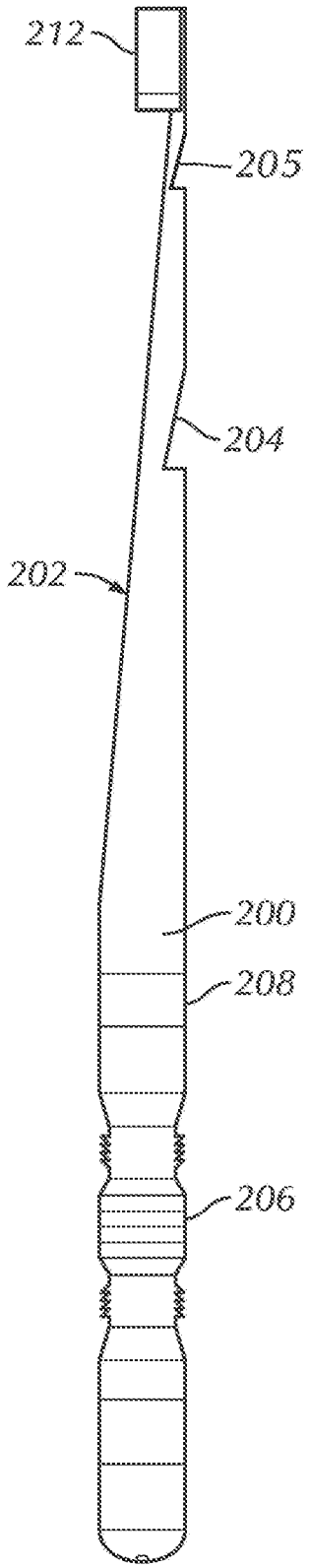

FIG. 8B depicts a side view of the whipstock (200) embodiment shown in FIG. 8A. This view shows the inclined nature of the deflection surface (202), as well as the design of the slot (205) in this embodiment.

Figure 9A:
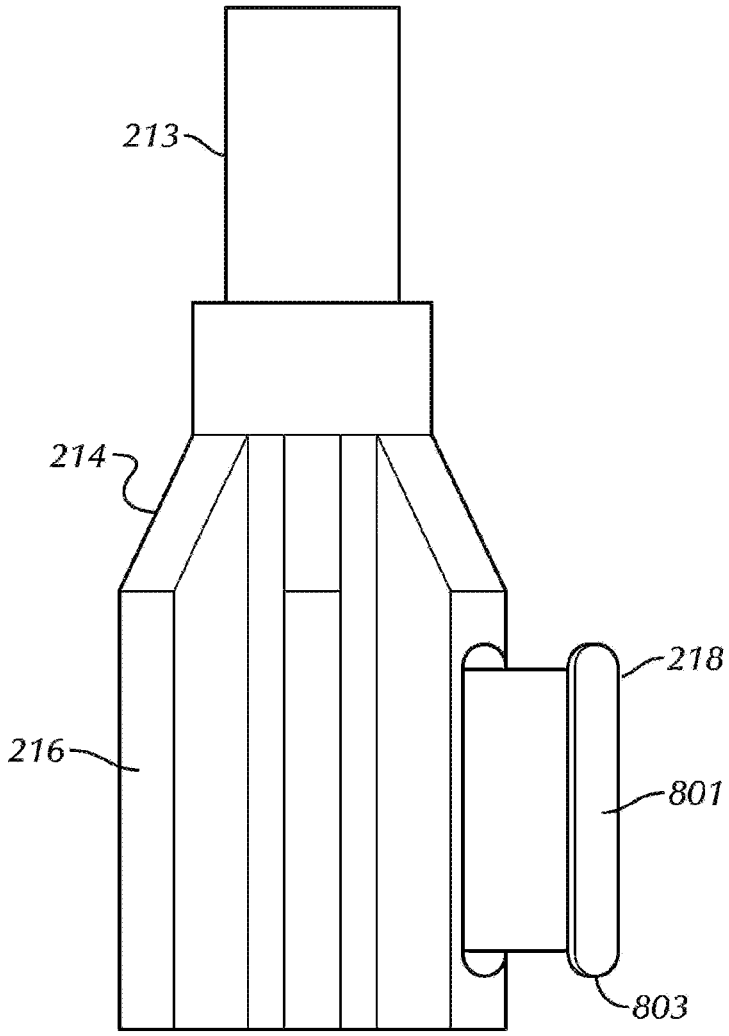
FIGS. 9A-9B are views showing a first engagement element profile and a corresponding second engagement element profile in accordance with one or more embodiments.

FIG. 9A shows, in accordance with one or more embodiments, embodiments of the mill bit (216) and pad (218). In accordance with one or more embodiments, the pad (218) is shown in the extended position and has a brim (801) that extends about a least a portion of the outer periphery (803) thereof. While the pad (218) and brim (801) are shown with a rounded design, a person of ordinary skill in the art would appreciate that there are a plurality of shapes that may be utilized.

Figure 9B:
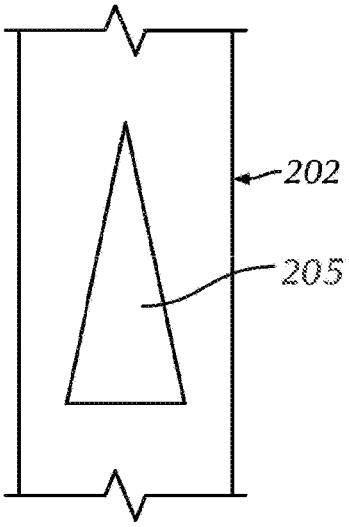

FIG. 9B depicts a triangular shaped slot (205) that extends through the deflection surface (202) of the whipstock (200). The taper of the triangle is oriented toward the upper end of the whipstock (200). The slot (205) may have a tapered shape with the taper being oriented toward the upper end of the whipstock (200). This improves the ability for the pad (218) to seat and remain secured in the slot (205).

Figure 10A:
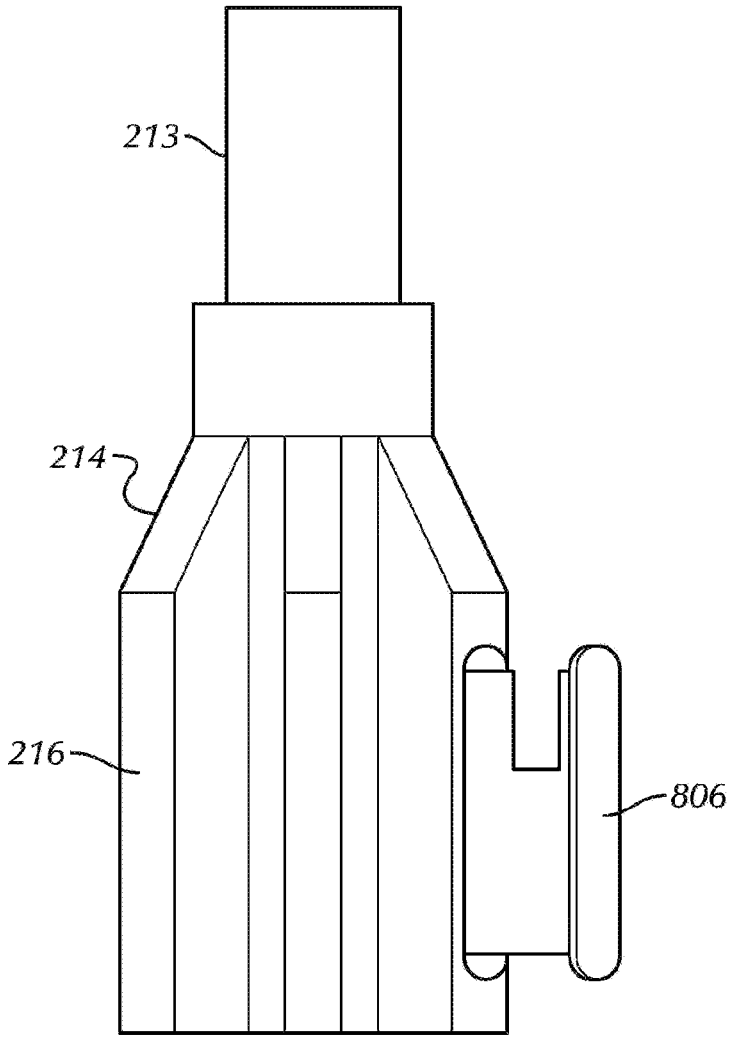
FIGS. 10A-10B are views showing a first engagement element profile and a corresponding second engagement element profile in accordance with one or more embodiments.
Figure 10B:
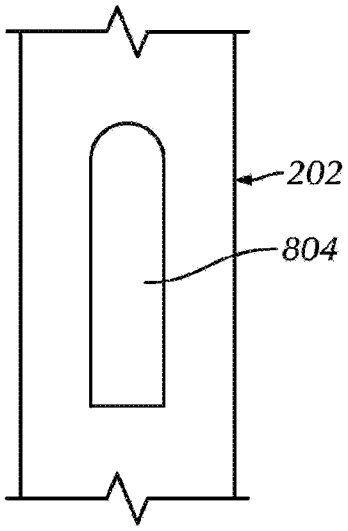

FIG. 10A depicts a hook shaped pad (806) in the extended position and FIG. 10B depicts an elongated slot (804) with a rounded top edge that extends through the deflection surface (202) of the whipstock (200). Advantageously, the hook shaped pad (806) of FIG. 10A allows the whipstock (200) to be rigidly seated on the pad (806), therefore improving the ability of the hook shaped pad (806) to retain the whipstock (200). These depictions are intended to be non-limiting examples and one of ordinary skill in the art would appreciate that there is a plurality of shapes that may be effectively utilized in the whipstock (200) retrieval operation.

Figure 11:
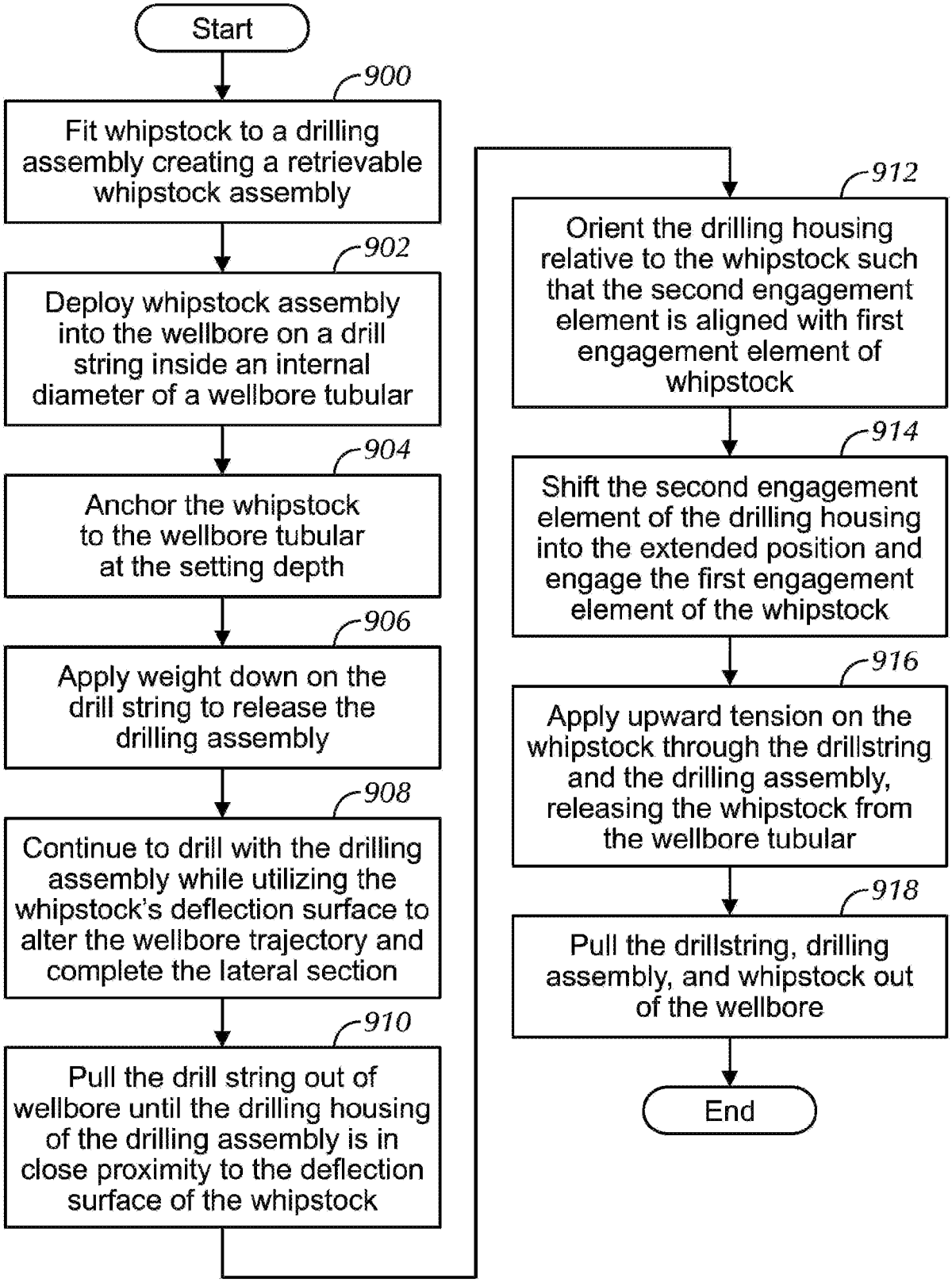
FIG. 11 is a flowchart in accordance with one or more embodiments.

FIG. 11 is a flowchart depicting, in accordance with one or more embodiments, an operations sequence for the installation and retrieval of a whipstock (200) in a wellbore (102). One or more blocks in FIG. 11 may be performed using one or more components as described in FIGS. 1 through 10B . While the various blocks in FIG. 11 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In Step 900, the whipstock (200) and drilling assembly (210) are fitted via the drilling assembly connector (212) at the surface (114). The drilling assembly connector (212) is releasable style connector that may be disconnected by, for example, a downward force that would shear the connector. Alternatively, a different releasable connector equivalent that one of ordinary skill in the art would appreciate may be utilized. For example, the whipstock (200) may be electromagnetically coupled to the drilling assembly (210). In this case, the whipstock (200) has a magnet (not shown) rigidly fixed opposite the concave surface of the whipstock (200). When the whipstock (200) is being lowered into the wellbore (102), an electromagnet (not shown) disposed on the drilling assembly (210) is energized and retains the whipstock (200) to the drilling assembly (210).

In Step 902, the whipstock (200) and drilling assembly (210) are deployed into the wellbore (102) inside the casing string (116) on the drill string (112) to the planned setting depth.

In Step 904, the anchor (206) is activated and the whipstock (200) is anchored to the inside of the casing string (116) at the setting depth. The anchor (206) may be of a standard retrievable hydraulic design, which includes a set of slips and an elastomeric sealing element or of a design known to one of ordinary skill in the art.

In Step 906, in accordance with one or more embodiments, weight is applied downward on the drilling assembly (210) via the drill string (112) and top drive (110). The applied weight shears the drilling assembly connector (212) separating the whipstock (200) from the drilling assembly (210). Alternatively, if the whipstock is electromagnetically retained to the drilling assembly (210) as described above, the electromagnet (not shown) is deenergized and the whipstock (200) is separated from the drilling assembly (210).

In Step 908, the drilling assembly (210) continues drilling while being redirected by the deflection surface (202) of the whipstock (200). The mill bit (216) is used to mill a window in the casing string (116) altering the trajectory of the wellbore (102) away from the mainbore (203) and toward a new lateral (220).

In Step 910, the lateral (220) has been drilled and the drilling assembly (210) is pulled back into the mainbore (203) to within close proximity of the deflection surface (202) of the whipstock (200).

In Step 912, in accordance with one or more embodiments, the drilling housing (214) is oriented, via the MWD or other tool (not shown) located in the BHA (124), to align the pad (218) of the drilling housing (214) with the slot (205) of the whipstock (200).

In Step 914, in accordance with one or more embodiments, hydraulic pressure is applied by pumping drilling fluid from surface into the inner bore of the drill string (112) and mill bit (216). The resultant hydraulic force applied to the base of the pad (218) shifts the pad (218) from the recessed position into the extended position. When in the extended position the pad (218) engages the slot (205) of the whipstock (200) and the drilling assembly (210) and the whipstock (200) are now connected.

In Step 916, the anchor (206) is released by applying an upward tension on the whipstock (200) through the drilling assembly (210) via the drill string (112) and top drive (110). This releases the anchor (206) and whipstock (200) from the casing string (116), such that the whipstock (200) is now only connected to the drilling assembly (210).

In Step 918, the drill string (112), the drilling assembly (210), and the whipstock (200) are pulled out of the wellbore (102) and recovered at surface (114)

Consistent with the above, embodiments of the present disclosure are directed towards devices and methods that aid in retrieving a whipstock (200) as a drilling assembly (210) is being removed from a wellbore (102). While embodiments of the present disclosure have been described with respect to a limited number of embodiments, those skilled in the art, having benefit of this disclosure, will appreciate that other embodiments can be devised which do not depart from the scope of the disclosure as disclosed herein. Specifically, a person of ordinary skill in the art would appreciate that although the embodiments of the invention have been described herein in relation to a mill bit (216) and drill bit (500), the embodiments of the invention may be applicable to other portions of the BHA, such as a string reamer or cutter bit. In addition, a person of ordinary skill in the art would appreciate that the embodiments of the invention are cross compatible, and components may be interchanged without deviating from the heart of the invention.

Embodiments of the present disclosure may provide at least one of the following advantages: reducing rig time, providing a built-in retrieval device that can be activated on demand to recover the whipstock with the initial setting assembly, and negating the need for an additional or dedicated trip into the wellbore.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. It is the express intention of the applicant not to invoke 35 U.S.C. § 112, paragraph for any limitations of any of the claims herein, except for those in which the claim expressly uses the words 'means for' together with an associated function.

What is claimed:

1. A retrievable whipstock assembly for a wellbore, comprising:

a whipstock comprising a longitudinal body and an anchor connection;

a deflection surface provided on the longitudinal body and having a first engagement element; and a drilling assembly comprising a drill housing and a second engagement element, wherein the second engagement element is selectively extendible between a recessed position and an extended position;

wherein in the extended position the second engagement element is engageable with the first engagement element, wherein the first engagement element comprises a slot that extends radially through the deflection surface of the whipstock, and wherein the drilling assembly further comprises a drill bit.

2. The retrievable whipstock assembly of claim 1, wherein the whipstock further comprises a drilling assembly connector releasably connecting the whipstock and the drilling assembly.

3. The retrievable whipstock assembly of claim 2, wherein the drilling assembly connector comprises a shear pin.

4. The retrievable whipstock assembly of claim 1, wherein the slot has a tapered shape.

5. The retrievable whipstock assembly of claim 1, wherein the second engagement element comprises an extendible pad.

6. The retrievable whipstock assembly of claim 5, wherein the extendible pad comprises a brim extending about at least a portion of an outer periphery thereof.

7. The retrievable whipstock assembly of claim 1, wherein:

the second engagement element is configured to be hydraulically actuated; and when hydraulic pressure is applied the second engagement element shifts from the recessed position to the extended position.

8. The retrievable whipstock assembly of claim 7, wherein the hydraulic pressure is applied by obstructing a fluid flow path in the drill housing.

9. The retrievable whipstock assembly of claim 8, wherein a ball obstructs the fluid flow path in the drill housing.

10. The retrievable whipstock assembly of claim 1, wherein the second engagement element is configured to be electro-hydraulically actuated.

11. The retrievable whipstock assembly of claim 10, further comprising:

an electronics module; and a valve controlled by the electronics module and configured to supply hydraulic pressure to the second engagement element;

wherein when the electronics module causes the valve to open, hydraulic pressure shifts the second engagement element into the extended position.

12. The retrievable whipstock assembly of claim 11, wherein the electronics module comprises a sensor configured to sense an activation device.

13. A method of installing and retrieving a whipstock in a wellbore, comprising:

deploying the whipstock into the wellbore, the whipstock comprising a first engagement element;

anchoring the whipstock in the wellbore at a setting depth;

drilling a lateral wellbore section with a drilling assembly;

pulling the drilling assembly out of the lateral wellbore section;

extending a selectively extendable second engagement element on the drilling assembly;

engaging the second engagement element with the first engagement element;

applying an upward tension on the whipstock to release the whipstock from the wellbore; and removing the drilling assembly and the whipstock from the wellbore together, and wherein the first engagement element comprises a slot that extends radially through a deflection surface of the whipstock.

14. The method of claim 13, wherein extending the second engagement element comprises hydraulic actuation.

15. The method of claim 13, wherein deploying the whipstock into the wellbore comprises releasably attaching the whipstock to the drilling assembly.

16. The method of claim 15, wherein deploying the whipstock into the wellbore further comprises releasing the whipstock by applying weight to the drilling assembly.

17. The method of claim 13, wherein deploying the whipstock, drilling the lateral wellbore section, and removing the drilling assembly and the whipstock are completed in a single trip into the wellbore.

18. A retrievable whipstock assembly for a wellbore, comprising:

a whipstock comprising a longitudinal body and an anchor connection;

a deflection surface provided on the longitudinal body and having a first engagement element; and a drilling assembly comprising a drill housing and a second engagement element, wherein the second engagement element is selectively extendible between a recessed position and an extended position;

wherein in the extended position the second engagement element is engageable with the first engagement element;

wherein the first engagement element comprises a slot that extends radially through the deflection surface of the whipstock, and wherein the drilling assembly further comprises a mill bit.

* * * * *